US006431283B1

(12) United States Patent
Dale

(10) Patent No.: US 6,431,283 B1
(45) Date of Patent: Aug. 13, 2002

(54) METHOD OF CASING MULTILATERAL WELLS AND ASSOCIATED APPARATUS

(75) Inventor: Dana R. Dale, Houston, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/648,998

(22) Filed: Aug. 28, 2000

(51) Int. Cl.[7] ..... E21B 7/08
(52) U.S. Cl. ..... 166/341; 166/313; 166/50
(58) Field of Search ..... 166/50, 52, 313, 166/366, 243, 341, 342, 349, 382

(56) References Cited

U.S. PATENT DOCUMENTS

| | | | | |
|---|---|---|---|---|
| 5,330,007 A | | 7/1994 | Collins et al. | |
| 5,353,876 A | | 10/1994 | Curington et al. | |
| 5,472,048 A | * | 12/1995 | Kennedy et al. | 166/50 |
| 5,787,987 A | * | 8/1998 | Forsyth et al. | 166/313 |
| 5,875,847 A | * | 3/1999 | Forsyth | 166/313 |
| 5,944,108 A | * | 8/1999 | Baugh et al. | 166/313 |
| 5,960,873 A | | 10/1999 | Alexander et al. | |
| 6,116,344 A | * | 9/2000 | Longbottom et al. | 166/298 |

FOREIGN PATENT DOCUMENTS

| | | |
|---|---|---|
| GB | 2315504 A | 2/1998 |
| GB | 2330159 A | 4/1999 |
| GB | 2340152 A | 2/2000 |

OTHER PUBLICATIONS

Saliumberger "Rapid Seal System—The Multilateral Advantage" Rapid Seal Brochure pp. 1–9, Dated Dec. 1, 2000.
Baker Hughes "Completing the World's First Level 6 Multilateral Well" Brochure, pp. 1–6; Dated Sep. 1998.
Baker Oil Tools "The Formation Structure Multilateral System" Brochure, pp. 1–2; Dated, Dec. 1, 2000.
Baker Oil Tools "Downhole Splitter System" Brochure, pp. 1–2 dated, Dec. 1, 2000.
Schlimberger "9 5/8 Rapid Seal Multilateral System" Brochure, pp. 8; Dated, Mar. 2000.

* cited by examiner

*Primary Examiner*—Frank Tsay
(74) *Attorney, Agent, or Firm*—William M. Imwalle; Marlin R. Smith

(57) ABSTRACT

A method of casing multilateral wells and associated apparatus provide increased diameter in wellbores drilled below a casing splitter. In a described embodiment, a casing splitter is positioned in a subsea wellbore with a minimum restriction of 18.565", with the casing splitter attached at a lower end of a 13⅜" casing string. Two 8½" bores extend through a lower end of the casing splitter, whereby only one standard casing size is skipped due to the wellbore junction formed by the casing splitter.

20 Claims, 2 Drawing Sheets

METHOD OF CASING MULTILATERAL WELLS AND ASSOCIATED APPARATUS

BACKGROUND OF THE INVENTION

The present invention relates generally to operations performed and equipment utilized in conjunction with subterranean wells and, in an embodiment described herein, more particularly provides methods of casing multilateral wells and apparatus for use therein.

It is well known to those skilled in the art that it is very difficult to provide a seal between large diameter linings (casings and liners) for lateral or branch wellbores extending outwardly from an intersection between the lateral or branch wellbore and a main or parent wellbore. This due to the fact that it is generally deemed favorable to position a wellbore "junction" at the intersection of the wellbores to provide sealing for the formations intersected by the wellbores, to stabilize the wellbore intersection, to provide facilities for sealing and connecting linings extending into the wellbores, etc. In order for the junction to be installed at the wellbore intersection, it must pass through the main or parent wellbore and must, therefore, be smaller in diameter than the main or parent wellbore.

Several solutions to this problem have been proposed. One solution is to collapse the junction before it is installed in the well, and then inflate or otherwise expand the junction after it is positioned at the wellbore intersection. Unfortunately, it is difficult to ensure that the expanded junction will have a particular desired geometry after it is expanded, and the expanded junction, by its very nature, is susceptible to being again collapsed due to forces experienced in the well.

Another solution is to provide the junction with a relatively short lateral branch tube extending from a side thereof. The branch tube must be short so that the junction will fit within the diameter of the main or parent wellbore. However, this short lateral branch tube makes it difficult to reliably secure and seal casings or liners thereto. Furthermore, the fact that the branch tube extends laterally from the junction restricts its diameter (due to the necessity of transporting the junction through the main or parent wellbore), such that more than one standard casing size must be skipped in the transition to the lateral or branch wellbore as compared to a normal well casing program for normally pressurized formations. Still further, the wall thicknesses of the branch tube and the new lining of the main or parent wellbore take up space and restrict the inner diameter available through them.

A third solution is to create a junction by attaching two or more divergent tubes to the bottom of a casing. This solution utilizes an orienting cam type seal assembly that stabs into a seal bore located on top of each of these tubes, and extends back to surface to direct access to a desired tube. These tubes are limited in size by their divergence, their wall thickness, the upset created by the seal bore, and by the necessity that the inside of the casing must completely circumscribe the attached seal bores in order for an orienting cam type seal assembly to stab into a seal bore. Several standard casing sizes must be skipped in the transition from the casing to the lateral or branch wellbore as compared to a normal well casing program for normally pressurized formations.

Accordingly, it may be clearly seen that a method of casing multilateral wells is needed which resolves the problems in the art at present. Specifically, it would be highly advantageous to provide a method of casing multilateral wells in which it is not necessary to initially collapse the wellbore junction and then to expand the wellbore junction downhole, the wellbore junction has a known geometry which is, for example, well suited for connecting and sealing casings and/or liners thereto, the wellbore junction does not require the skipping of more than one standard casing size, and the wellbore junction conveniently utilizes standard wellbore and casing sizes to achieve these objectives.

SUMMARY OF THE INVENTION

In carrying out the principles of the present invention, in accordance with an embodiment thereof, a method of sealing the junction of subsea multilateral wells which have a large 20" surface casing is provided in which a uniquely configured casing splitter forms a wellbore junction. The casing splitter is dimensioned so that only one standard casing size is skipped in providing the wellbore junction, and yet the casing splitter conveniently fits through standard main or parent wellbores, does not require collapse or expansion thereof, and provides ample facilities for connecting and sealing casing strings thereto.

In one aspect of the present invention, the casing splitter is dimensioned so that it fits within and through an existing 18.565" wellhead bore and 20" surface casing. This size of wellhead and surface casing is typical of those installed on the ocean floor for subsea production. In this manner, the casing splitter may be attached at a lower end of an otherwise standard 13⅜" intermediate casing string. The casing splitter has two 8½" diameter bores formed in a lower end thereof, of a length sufficient to anchor and seal subsequent liners therein, and which share and are separated by a single wall thickness of preferably no more than 0.435". The splitter is attached to the bottom of the 13⅜" casing string before it is installed.

In another aspect of the present invention, wellbores may be drilled through one or more lower connections of the casing splitter. Since only one standard casing size is skipped when utilizing the casing splitter, multiple standard liner sizes are available for use in wellbores drilled below the casing splitter. Because the lower bores of the casing splitter are parallel, they may be of any convenient length to anchor the liners therein. Multiple liner strings in the wellbores drilled through the casing splitter would typically be telescoped in progressively stepped down wellbore diameters.

In a further aspect of the present invention, the casing splitter may have a 13⅜" threaded casing connection formed on an upper end thereof, and a 9⅝" flush joint threaded casing connection formed on a lower end thereof. Recesses may be machined outwardly from one or both of the 8½" bores orthogonally to the other 8½" bore to aid in locating and securing the subsequent liners.

In a still further aspect of the present invention, access to individual laterals may be achieved using a bent sub, or a diverter may be disposed in the casing splitter. The diverter may be positioned to permit access between the 13⅜" casing connection and one of the 8½" bores while preventing access between the 13⅜" casing connection and the other bore. A latch or mule-shoe may be placed on the outside of the diverter, and a matching profile machined on the inside of the casing splitter, to assist in orientation.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
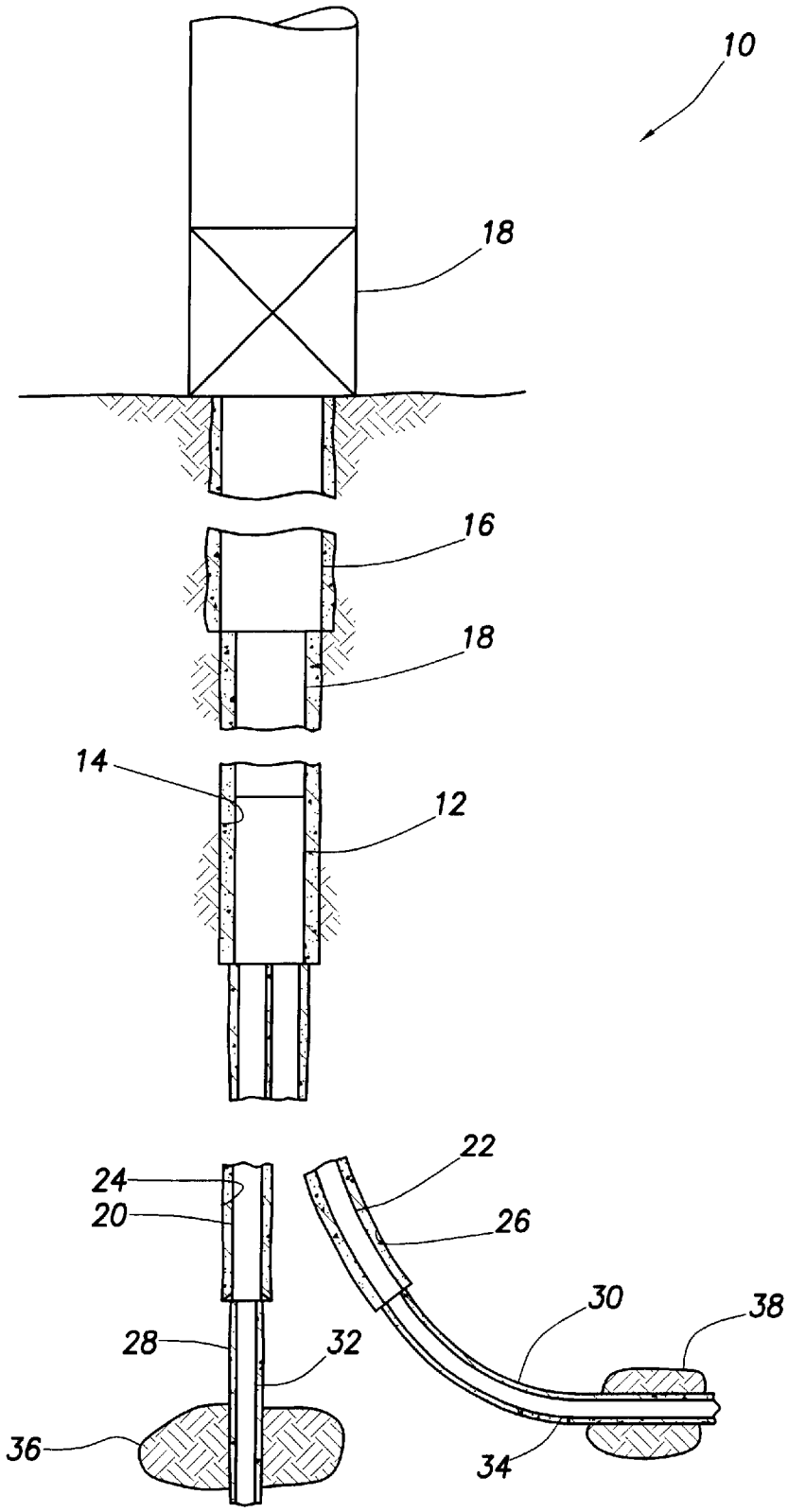
FIG. 1 is a schematic view of a method of casing a multilateral well, the method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein maybe utilized in various orientations, such as inclined, inverted, horizontal, vertical, etc., and in various configurations, without departing from the principles of the present invention.

In the method 10, advantageous use is made of standard wellbore and casing sizes to provide a wellbore junction having characteristics unrealized in the past. Specifically, a casing splitter 12 is positioned in a nominal 22" wellbore 14. This wellbore is underreamed below a 20" casing string in a typical casing program, for example, the 20" casing string 16 depicted in FIG. 1. The components of this casing string on a subsea well generally allow passage of equipment up to 18.565" in diameter. Specifically, a wellhead 17 in this type of drilling program typically has a 18.565" restriction therein.

The present inventor has discovered that, by configuring the casing splitter 12 so that it fits within the 18.565" limitation, it will connect to a 13⅜" casing string 18 on top and may have two linings 20, 22 connected on bottom extending outwardly from two 8½" bores formed in the casing splitter, which share a common wall thickness, such that only one standard casing size is skipped in providing the wellbore junction. This is a significant advantage over prior wellbore junction methods.

The ability to fit the casing splitter 12 within the 18.565" diameter-limited wellbore 14 is enhanced by providing for the lower linings 20, 22 to extend parallel to each other initially as they extend downwardly away from the casing splitter. In this manner, it is not necessary to have a branch tube exiting laterally from the casing splitter 12, or for the linings 20, 22 to initially diverge from each other at all, which would require a larger, nonstandard wellbore size or a reduction in casing size to accommodate. In addition, the use of a flush joint casing connection in the lower end of one of the casing splitter 12 lower bores permits a casing string, such as a 9⅝" casing string, to be installed in the well below the casing splitter, if desired. Sealing hangers (not shown) are used to connect one or both of the linings 20, 22 to the casing splitter.

Thus, in the method 10, the casing splitter 12 is connected to a lower end of the 13⅜" intermediate casing string 18 and positioned therewith in the underreamed wellbore 14 drilled below the 20" surface casing string 16. At this point, one casing string 20 may be already connected to the lower end of the casing splitter 12 (e.g., using flush joint threaded connections), or the liner strings may be connected later using conventional hangers, etc.

If the casing splitter 12 is run without the lower linings 20, 22, then cementing equipment, such as a float shoe, etc., maybe installed in the lower end of the casing splitter. The casing splitter 12 is then cemented in the wellbore 14 with the remainder of the 13⅜" casing string 18. The liner strings 20, 22 are then installed in wellbores 24, 26 drilled through the lower end of the casing splitter 12. If the lower casing string 20 is connected to the casing splitter 12 when it is initially installed in the wellbore 14, the casing string 20 may also be cemented into the wellbore 14 along with the casing splitter.

As depicted in FIG. 1, the liner strings 20, 22 have been installed in the wellbores 24, 26 drilled through the lower end of the casing splitter 12. One or both of the wellbores 24, 26 may deviate from vertical, for example, the wellbore 26 as shown in FIG. 1. Additional smaller diameter wellbores 28, 30 may be drilled below the liner strings 20, 22, and liners 32, 34 or other liner strings may be installed in the wellbores. Thus, progressively smaller wellbores may be drilled below the liner strings 20, 22, with additional liner strings being telescopingly received in these wellbores.

FIG. 1 illustrates the liner 32 in the wellbore 28, which intersects a formation or zone 36, and the liner 34 in the wellbore 30, which intersects the same or another formation or zone 38. The use of the casing splitter 12 in the method 10 provides a stabilized, secure, collapse resistant, sealed and large diameter junction for production from, or injection into, each of the zones 36, 38. This result is accomplished using standard wellbore sizes and standard casing sizes, with only one standard casing size being skipped in providing the junction between the three wellbores 14, 24, 26.

Note that the method 10 is depicted in FIG. 1 as being performed in a subsea well environment, but it is to be clearly understood that surface wells may also benefit from the principles of the present invention. In addition, although the lower liner strings 20, 22 are preferably standard 7 or 7⅝" liner strings as described above, other sizes of casing or liner strings may be utilized, without departing from the principles of the present invention. For example, smaller sized liner strings may be used in some circumstances if the liner strings are installed through the casing splitter 12.

Figure 2:
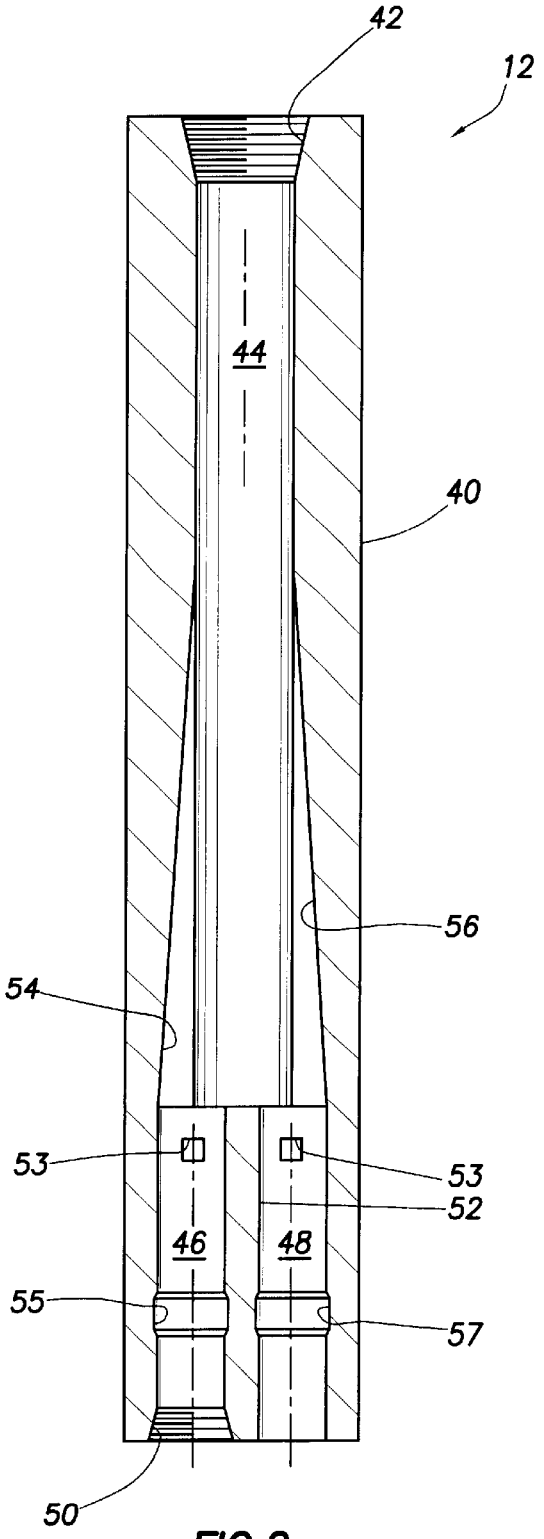
FIG. 2 is a cross-sectional view of a casing splitter utilized in the method of FIG. 1.

Referring additionally to FIG. 2, a cross-sectional view of the casing splitter 12 embodying principles of the present invention is representatively illustrated. The casing splitter 12 includes a cylindrical housing 40 having an outer diameter somewhat smaller than the inside diameter of a nominal 18.565" wellhead. A standard 13⅜" threaded casing connection 42 is formed in the top of the housing 40 at an end of a main bore 44 formed in the housing.

Two parallel 8½" diameter bores 46, 48 are formed extending upwardly from the bottom of the housing 40. The bores 46, 48 preferably share a common wall 52 having a thickness of no more than 0.435". A flush joint threaded connection 50 may be provided in the case described above wherein a casing string is initially connected to the bottom of the casing splitter 12.

If the liner strings are connected to the casing splitter 12 after it is installed in the well, hangers or other devices may be used to hang the liner strings in the bores 46, 48, without the need for threaded connections. Note that a particular benefit of the parallel arrangement of the bores 46, 48 in that case is that the bores may be made as long as needed to provide a secure and adequately sealed connection between the casing splitter and the liner strings. Recesses 53 may be machined outwardly from one or both of the 8½" bores orthogonally to the other 8½" bore to aid in locating and securing the subsequent liners. Profiles 55, 57 capable of supporting the liner strings may be formed in the bores 46, 48.

To provide a transition between the bore 44 and each of the bores 46, 48, additional bores 54, 56 are formed in the housing 40. The bore 54 extends between a centerline of the bore 44 and a centerline of the bore 46. The bore 56 extends between the centerline of the bore 44 and a centerline of the bore 48. The bores 54, 56 permit passage of tools, equipment, etc. conveniently through the housing 40 between the casing and liner strings connected thereto.

Note that the bores 54, 56 may not be necessary, for example, if the bores 46, 48 intersect the bore 44 as depicted in FIG. 2. However, it also is not necessary for the bores 46, 48 to intersect the bore 44, in keeping with the principles of the present invention.

Figure 3:
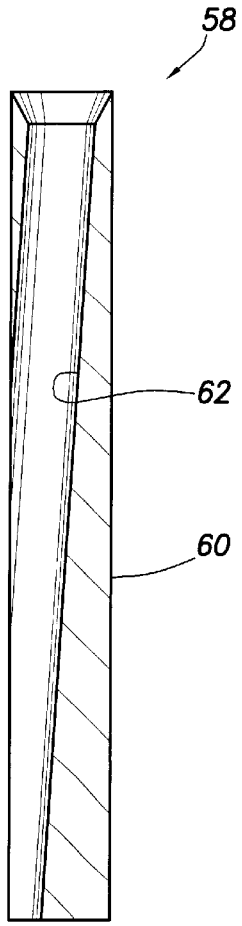
FIG. 3 is a cross-sectional view of a diverter which may be installed in the casing splitter of FIG. 2.

Referring additionally now to FIG. 3, a diverter 58 which may be used in conjunction with the casing splitter 12 is representatively illustrated. The diverter 58 includes a cylindrical housing 60 having an outside diameter which permits it to be installed within the bore 44 of the housing 40.

An inclined bore 62 is formed in the housing 60. The bore 62 is centered in the housing 60 at the top, but is offset from the center of the housing at the bottom. In this manner, when the diverter 58 is installed in the bore 44 of the housing 40, the bore 62 will be aligned with the bore 44 on top, and will be aligned with one of the bores 54, 56 on bottom.

Thus, when the diverter 58 is installed in the housing 40, it is oriented so that its bore 62 is rotationally aligned with a selected one of the bores 54, 56. The selected one of the bores 54, 56, combined with the bore 62, then forms a path between the bore 44 and the corresponding selected one of the bores 46, 48. The diverter 58, therefore, permits access between the casing string connected to the top of the casing splitter 12 and a selected one of the liner or casing strings connected to the bottom of the casing splitter. A conventional latch or mule-shoe may be placed on the outside of the diverter 58, and a matching profile machined on the inside of the housing 40, to assist in orientation.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of casing a subsea well, the method comprising the steps of:

forming two approximately 8½" bores in a lower end of a casing splitter, the 8½" bores sharing a common wall thickness;

installing the casing splitter on a lower end of a 13⅜" casing string; and positioning the 13⅜" casing string in a first wellbore of the subsea well.

2. The method according to claim 1, wherein in the positioning step, a 9⅝" casing string is connected to one of the bores in the lower end of the casing splitter.

3. The method according to claim 1, further comprising the step of hanging a selected one or more of 7" and 7⅝ liner strings from the lower end of the casing splitter after the positioning step.

4. The method according to claim 1, wherein in the installing step, the casing splitter has a 13⅜" casing connection formed on an upper end thereof and a profiles capable of supporting a liners formed in each of the 8½" bores.

5. The method according to claim 1, further comprising the step of cementing the casing splitter in the first wellbore prior to hanging liner strings from the lower end of the casing splitter.

6. The method according to claim 5, wherein the hanging step further comprises drilling second and third wellbores through the lower end of the casing splitter, and wherein a selected one or more of 7" and 7⅝ liner strings is positioned in each of the second and third wellbores.

7. The method according to claim 1, further comprising the steps of positioning a first selected one of 7" and 7⅝ liner string in a second wellbore drilled through the lower end of the casing splitter, and installing a second liner string in the second wellbore through the first liner string.

8. A method of casing a well, the method comprising the steps of:

installing a casing splitter on a lower end of a casing string;

positioning the casing string in a first wellbore of the well;

drilling a second wellbore through a lower end of the casing splitter;

connecting a first liner string to the lower end of the casing splitter;

positioning the first liner string in the second wellbore; and installing at least a second liner string in the second wellbore through the first liner string.

9. The method according to claim 8, further comprising the step of connecting a third liner string to the lower end of the casing splitter.

10. The method according to claim 9, wherein the first casing string is a 13⅜" casing string, and each of the first and third liner strings is a selected one of 7" and 7⅝".

11. The method according to claim 9, further comprising the step of positioning the third liner string in a third wellbore drilled through the lower end of the casing splitter.

12. The method according to claim 9, further comprising the step of cementing the casing splitter in the first wellbore prior to the first and second liner string connecting steps.

13. A casing splitter apparatus, comprising:

an elongated housing having an upper end and a lower end, the upper end having a threaded 13⅜" casing connection formed thereon, and the lower end having first and second 8½" diameter bores formed therein.

14. The apparatus according to claim 13, wherein the first and second bores are parallel to each other.

15. A casing splitter apparatus, comprising:

an elongated housing having an upper end and a lower end, the upper end having a threaded 13⅜" casing connection formed thereon, and the lower end having first and second 8½" diameter bores formed therein, a third bore extending into the housing from the 13⅜" casing connection, a fourth bore extending between a centerline of the first and third bores, and a fifth bore extending between a centerline of the second bore and the third bore centerline.

16. A casing splitter apparatus, comprising:

an elongated housing having an upper end and a lower end, the upper end having a threaded 13⅜" casing connection formed thereon, and the lower end having first and second 8½" diameter bores formed therein; and a diverter received within the housing, the diverter permitting access between the 13⅜" casing connection and a selected one of the first and second bores.

17. A casing splitter system, comprising:

a casing splitter positioned in a wellbore, the casing splitter having a 13⅜ casing string attached at an upper end thereof and two approximately 8½" bores extending inwardly from a lower end thereof, the two 8½" bores being parallel to each other within the casing splitter.

18. The system according to claim 17, wherein a 9⅝ casing string is threaded to a connection at a lower end of one of the 8½" bores.

19. A casing splitter system, comprising:

a casing splitter positioned in a wellbore, the casing splitter having a 13⅜" casing string attached at an upper end thereof and two approximately 8½" bores extending inwardly from a lower end thereof, the two 8½" bores being parallel to each other within the casing splitter, a single wall thickness of approximately 0.435" separating the 8½" bores.

20. A casing splitter system, comprising:

a casing splitter positioned in a wellbore, the casing splitter having a 13⅜" casing string attached at an upper end thereof and two approximately 8½" bores extending inwardly from a lower end thereof, the two 8½" bores being parallel to each other within the casing splitter, a wellhead of the wellbore containing an approximately 18.565" restriction through which the casing splitter is installed in the wellbore.

* * * * *